US008653981B2

(12) United States Patent
Barbaud

(10) Patent No.: US 8,653,981 B2
(45) Date of Patent: Feb. 18, 2014

(54) SAFETY DEVICE FOR UNDERWATER DIVING

(75) Inventor: Axel Barbaud, Toulon (FR)

(73) Assignee: BF Systemes, La Seyne sur Mer (FR)

( * ) Notice: Subject to any disclaimer, the term of this patent is extended or adjusted under 35 U.S.C. 154(b) by 644 days.

(21) Appl. No.: 12/812,787

(22) PCT Filed: Jan. 12, 2009

(86) PCT No.: PCT/IB2009/000032

§ 371 (c)(1),
(2), (4) Date: Jul. 14, 2010

(87) PCT Pub. No.: WO2009/090529

PCT Pub. Date: Jul. 23, 2009

(65) Prior Publication Data

US 2010/0309006 A1 Dec. 9, 2010

(30) Foreign Application Priority Data

Jan. 16, 2008 (FR) ..... 08 00215

(51) Int. Cl.
*G08B 17/10* (2006.01)

(52) U.S. Cl.
USPC ..... 340/632; 340/573.6; 340/539.1

(58) Field of Classification Search
USPC ..... 340/632, 573.6, 541, 850, 573.1, 340/539.26, 529, 539.1, 455
See application file for complete search history.

(56) References Cited

U.S. PATENT DOCUMENTS

| | | | | |
|---|---|---|---|---|
| 3,810,146 | A * | 5/1974 | Lieb | 340/541 |
| 5,049,859 | A * | 9/1991 | Arnell | 340/573.6 |
| 5,363,298 | A * | 11/1994 | Survanshi et al. | 73/865.1 |
| 7,388,512 | B1 * | 6/2008 | Moorer, Jr. | 340/850 |
| 7,642,921 | B2 * | 1/2010 | Cutler et al. | 340/573.6 |
| 8,144,020 | B2 * | 3/2012 | Snyder et al. | 340/573.6 |
| 2006/0020208 | A1 * | 1/2006 | Egozi | 600/458 |
| 2009/0135022 | A1 * | 5/2009 | Hollis et al. | 340/850 |

FOREIGN PATENT DOCUMENTS

| | | |
|---|---|---|
| EP | 1806276 A2 | 7/2007 |
| GB | 2439347 A | 12/2007 |

* cited by examiner

*Primary Examiner* — Daniel Previl
(74) *Attorney, Agent, or Firm* — Bachman & LaPointe, P.C.

(57) ABSTRACT

A safety device for underwater diving has a sensor for measuring a flow of gas bubbles comprising a belt for fixing and functional coupling to the body of a diver. The flow sensor is linked to a portable computer for utilizing signals from the flow sensor so as to provide an alarm signal if the measured flow level exceeds a predetermined safety threshold and to thus customize a table of decompression stops.

15 Claims, 2 Drawing Sheets

SAFETY DEVICE FOR UNDERWATER DIVING

BACKGROUND

The present invention relates to underwater diving with cylinders.

A diver wearing diving equipment with cylinders who has descended to around several tens of meters under the water surface must respect an ascent profile, i,e., limit his average ascent rate. In fact, during the descent, the increasing pressure causes an increasing dissolution of the gas breathed in the tissues irrigated by the blood, i.e., a storage that increases with depth and duration.

During the ascent, the ambient pressure will obviously decrease and the opposite phenomenon will take place. If this ascent is too fast, the desaturation of the gas dissolved in the tissues causes the formation of bubbles. If these come to represent a significant volume they may cause serious disorders and even lesions as they represent an additional volume which will compress the neighboring tissues. The limbs, lungs and even the central nervous system may be affected. The obstruction of the blood vessels by bubbles at the venous or arterial level leads to more serious outcomes.

Typically, a diver wears around his wrist a computer which calculates, during the ascent, an integral of the duration and depth of a dive for reading a previously-stored ascent table which displays the duration to respect for a sequence of decompression stops at staged depths.

The computer manufacturer establishes the ascent time profile table based on an algorithm from modelization of a pattern of gaseous exchanges within the tissues. This algorithm is built based on theoretical and experimental data, i.e., physical, physiological and biological data.

However, it turns out that many diving accidents still occur even when the diver has respected the decompression table. In fact, the individual susceptibility of every diver, particularly his physical condition on the day of the dive, constitutes a significant uncertainty factor as to the validity of the table.

SUMMARY OF THE INVENTION

The aim of the present invention is to reduce this uncertainty and hence, the related risk.

To this end, the present invention relates at first to a safety device for underwater diving, comprising a hand-held computer for receiving, through link means and utilizing signals from a sensor for measuring a flow of gas bubbles comprising means for fixing and functional coupling to the body of a diver, the computer being arranged to provide an alarm signal by alarm means if the measured flow level exceeds a predetermined safety threshold.

Thus, as soon as the hazardous phenomenon of excessive desaturation starts, it is detected and the diver is warned. Thus, he can take any necessary measure, i.e., lengthen a decompression stop or plan an intermediary stop, i.e., usually, limit the overall ascent slope with respect to duration. Particularly, in the case of two very close successive dives with, therefore, only partial desaturation of the tissues, the device will thus take into account this physical state of the diver in order to warn him in time, contrary to a standard dive computer which is not customized.

It should be noted that the device may be used instead of a dive computer which displays the table of the durations of the decompression stops, or used in addition to such a computer, particularly, by integrating the functions of the invention in this computer.

In other words, the device of the invention only provides, as an elementary configuration, a danger warning, in order to respect a physiological profile specific to the diver, but obviously, it is preferable to have a table display of the intended decompression stops in order to avoid reaching the safety barrier which constitutes the alarm signal provided by the present device too often.

This device may be used by a diver equipped with a breathing apparatus based on cylinders possibly with a recycling device, or by aquanaut using a surface supplied breathing apparatus or a system diving device, i.e., a hyperbaric chamber and a mobile bell functioning as a submarine lift. It may also be used by anyone in a decompression phase in a hypobaric chamber for example an astronaut before going into outer space in a space suit.

The claimed device may be limited to the computer, without the flow sensor, as such a computer constitutes an intermediary means for solving the posed problem. Conversely, the flow sensor may be provided and even possibly integrated in the computer.

Advantageously, the computer is further arranged to receive signals of ambient water pressure, from a pressure sensor and to provide a warning signal if the bubble flow level exceeds a warning threshold whereas the water pressure exceeds yet another high threshold value.

The possible appearance of bubbles in the blood usually only occurs after an ascent of a few dozen meters from the water surface. So, if level of bubbles, even a low level, is detected at twenty meters from the water surface, it does not constitute per se an immediate medical danger it represents a pre-warning information, signaling a danger risk if the ascent is pursued immediately.

The calculator advantageously contains calculation circuits of a basic table, of durations of decompression stops, and a central processing unit is arranged to modulate each duration by adding a supplement calculated according to an increasing function of flow measurement.

As outlined above, the quantified data of decompression duration facilitate the respect of a determined ascent profile, and the device serves to signal that this profile is not respected or that it is inappropriate for the moment for the diver in question. The table can take into account a gas storage value calculated by measuring and integrating the gas flowrate used up from a cylinder of known capacity, to thus provide, in case of quasi-exhaustion of the storage, a maximum ascent speed which stills remains compatible with the risk related to the presence of bubbles. The modulation above may relate to zero duration stops, i.e., intermediary stops between the non-zero duration stops may be added.

The central processing unit may thus be arranged to improve, with memorization, the basic table according to said modulation.

Thus, a type of history of the corrections brought is constituted. As, however, these corrections depend in part on the physical condition of the diver on the actual day, hence, they are not entirely valid from one day to another. The evolution "according to" the modulation thus preferably represents an amortized correction i.e., partial correction of the table with respect to the supplement calculated above. It is thus a low-pass filter, i.e., of an integrator filter function whereof the output tends to progressively adjust, from one dive to the next, on said supplement, knowing that the latter will tend to diminish as the device will gradually adapt to the reactions of the diver, in terms of bubble generation.

The fixing means are advantageously arranged so that the flow sensor is coupled to a vascular site.

Thus, it is possible to detect for example the venous blood flow at the right cardiac cavities, for example at the pulmonary artery or detect the arterial blood flow at the carotid or temporal level.

The linking means preferably comprise a wireless transmitter, for example of acoustic or electromagnetic signals.

Thus, the inconvenience constituted by a data link wire is avoided.

Advantageously, the hand-held computer comprises a wireless connection transceiver, for example acoustic or radio, for exchanging said warning signals with another same device.

The divers of a same group may thus keep each other aware of their physical state and, if needed, be helped if a diver does not take into consideration a warning signal.

Particularly, if the diver fails to comply with the instructions of the ascent speed limit indicated by the warning signal, for example if he is unconscious, it is interesting to provide activating means to modify the buoyancy of the device in case of said alarm signal.

Thus, the ascent speed of the diver is limited.

Also activating means for example, which are arranged to be activated by the computer in case the alarm goes off, to allow an inlet of safety gas into a breathing supply circuit of the diver.

Thus, for example, a three-way gate, mounted downstream from a pressure reducing valve, makes it possible to inject a mixture of oxygen-rich gas, in the normal breathing mixture as the oxygen has an antagonistic effect with respect to the bubble formation phenomenon, and a vasodilator effect which limits the obstruction risk by a bubble.

In a particular application, the device is associated to a database for setting-up a universal dive profile, the device comprising memorizing means for memorizing a history of a decompression profile followed-up by the diver, in association with the possible alarm signals along risky sections of the profile in alternation with safe sections, and the database being arranged for collecting the history data of said device as well as of other same devices, and for determining an envelope curve of the risky sections.

The database may be inside the computer or outside it if the necessary computing power exceeds that of a standard microprocessor. In this case, the computer has a circuitry for linking with the database, for example to access it via the Internet, or the memorizing means are removable, for example a magnetic bubble memory, that is temporarily transferred to the database to be copied thereinto. The history will thus indicate which are the danger-free sections and the risky sections, associated to the presence of an alarm signal. The history may for example have environmental data such as the pressure or the bubble flow level, and individual data such as height, weight and age of the diver.

Each history is thus equal to an equation of a certain number of parameters or variables such as those indicated above. Thus, when having a large number of such equations, a regression calculation may be carried out to evaluate the weighting to assign to each variable and even the correlations that may exist between some of these. The regression calculation consists in fixing an a priori value to each variable, which gives an a priori erroneous equation result for most of these. In a first stage, by varying one of the variables, a local optimum value for which the sum of errors of the equations is minimal may be determined. In a second stage, the same is done for a second variable. In a third stage, the same is done for a third variable, or the local optimum value is thus refined from the first variable, which may have been modified by the changes brought to the second variable. The set of variables is thus treated, with, if needed, several runs for each variable as indicated. This regression analysis thus makes it possible to dissociate the causal effect of each variable, i.e., to discern eigenvectors in a vector space constituted by these variables. The causal effect above is particularly the bubble level.

The database thus allows a user, be it human or electronic, through compilation of the history of several such devices, to determine the envelope curve of the risky sections. Hence it is about a collection of knowledge of the causal effects above. Starting from there, a user could define any desired profile of universal decompression table statistically tolerated by most divers, as the database will indicate any possible risky section of this profile. A safety margin with respect to the envelope curve is preferably provided, for example an additional duration per stop is added in order to take into account exceptions of future "non standard" divers, i.e., whereof the tissue are more prone to produce bubbles prematurely.

In order to define the envelope curve, and hence take into account each risky segment, which defines a section of diving depths whereon there is an alarm and the ascent speed in it, it is preferable to also take into account the starting portion of the history, preceding the segment, as the stored quantity of gas breathed depends on the various depths reached and on the corresponding duration. In other words, a same ascent speed between two stops could, from one dive to the next, lead to an alarm or not, depending on whether the dive was deep and/or of long duration or, respectively, shallow and/or of short duration.

The invention also relates to the use of a safety device according to the invention, characterized by the fact that, having obtained a said device, said fixing and functional coupling means are coupled to the body of a diver housed in a decompression chamber and a progressive reduction of an overpressure level in the decompression chamber by monitoring said alarm means to temporarily slow down, and for example stop for a certain time, said reduction in case of alarm.

BRIEF DESCRIPTION OF THE DRAWINGS

The invention will be better understood from the following description of an embodiment of a safety device according to the invention, with reference to the accompanying drawing, in which.

DETAILED DESCRIPTION OF THE PREFERRED EMBODIMENT(S)

Figure 1:
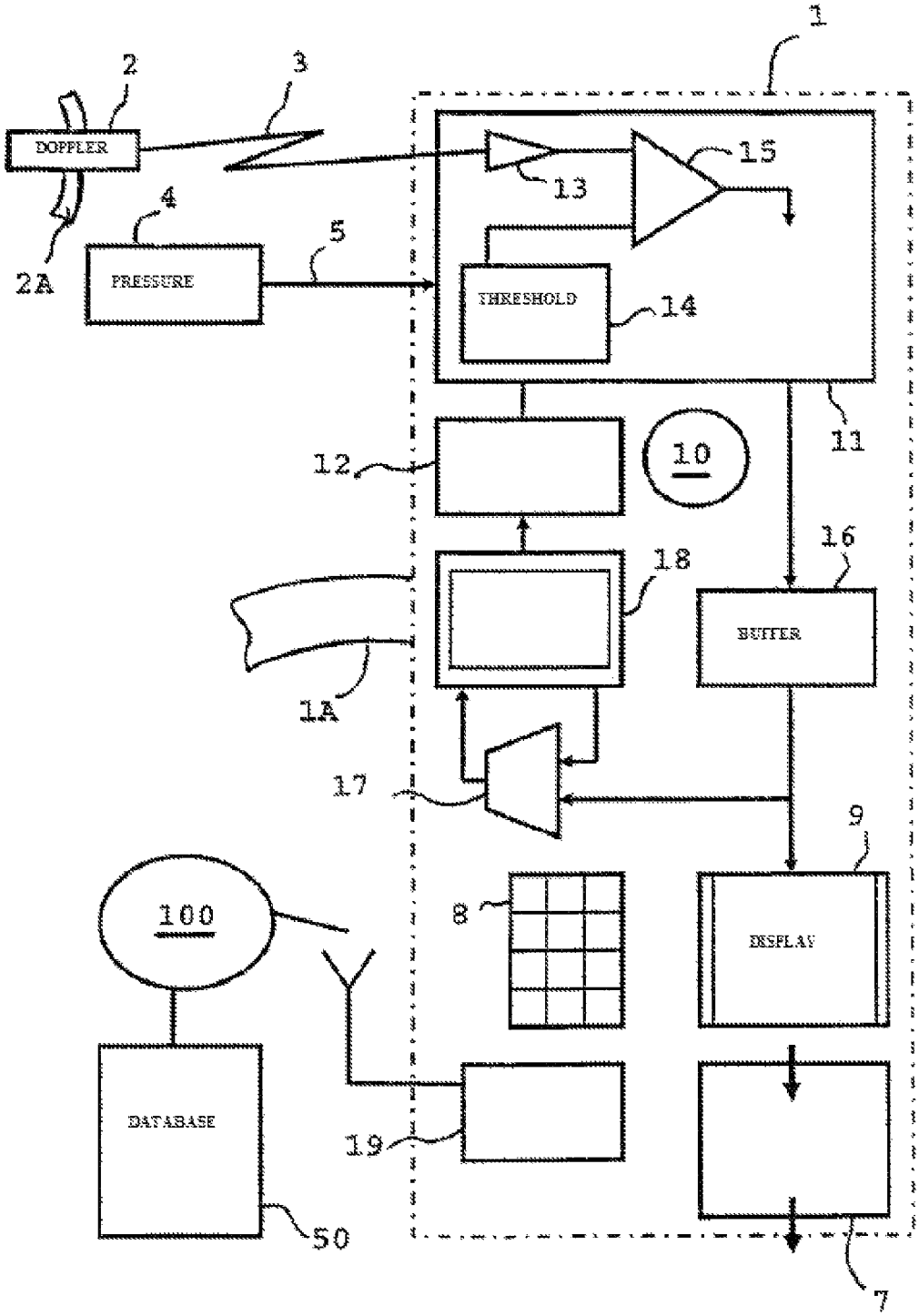
FIG. 1 is a schematic diagram of the constituting components.

FIG. 1 represents a hand-held computer 1 whereof the case is provided with an arm guard 1A so that a diver may wear it easily and check its display 9 of durations of decompression stops and safety or alarm signals. Here, the hand-held computer 1 is even hand-held, i.e., it only weights a few hundred grams or so, knowing meanwhile that it is the "limited volume" aspect that is essential for convenience of use, as the water pressure exerts an ascending force, lower, equal to or higher than the weight. Also, a keyboard 8 is provided for querying a central processing unit 11, and for establishing an external connection by means of transceiver circuits 19. Circuits 19 are preferably of acoustic type for connections through water and preferably radio for air connections. Both types of circuits 19 may be provided.

Fundamentally, the invention aims to provide an alarm signal indicating that gas bubbles have appeared in the body of the diver, who is thus in a decompression phase ascending to the water surface, and that these bubbles have just reached an alarming general volume. The diver is thus implicitly invited to interrupt his ascent to the water surface. By way of publications relating to diving, the following titles may be cited: "Physiology and medicin of diving", $5^{th}$ edition, 2003 authors Bennet and Elliot, editors Alf O Brubakk and Tom S. Neyman, SAUNDERS collection; "Physiologie et medicine de la plongée", authors Broussolle and Meliet, Ellipses editions, 2006; Automatic evaluation of bubbles in bloodstream: parametric methods, in: Traitement du signal, FR, vol. 9, n. 2, 1992, pages 201-210, GRETSI editor, Saint-Martin d'Hères, France; "On the Use of a Bubble Formation Model to Calculate Diving Tables", Aviation, Space, and Environment Medicine, authors D E Yount, D C Hoffman.

Computer 1 is informed about this by a sensor capable of detecting these bubbles and of measuring the importance thereof. In this example, this detection is carried out by a phonic measure carried out by means of a Doppler sensor 2 the case of which is provided with a belt 2A for maintaining the sensor 2 on one area of the body in which it possible to perceive the sound of blood circulation, possibly affected by the presence of gas bubbles. Here, the belt 2A maintains the phonic sensor 2 on the chest, at the vicinity of the right cardiac cavity or pulmonary artery, i.e., on the left border of the sternum.

The noise level is usually classified according to five ranges, starting from a degree 0, with a total absence of bubbles, a degree 1, with the presence of isolated bubbles, a degree 2, with the presence of bubbles in less than half the cardiac cycles, a degree 3, with the presence of bubbles in all the cardiac cycles without covering the heart sounds, and a degree 4 for which the bubbles cover the sounds of the heart. The measure of the bubble flowrate may be refined by using velocity indexes or by means of other mathematical quantifiers.

The computer 1 comprises a time base 10 timing the functioning of the central processor unit 11 associated with circuits 12 for calculating a basic table providing durations of decompression stops. These durations are calculated according to a weighted rollup of each hold time at the various dive depths reached. The weighting takes into account the fact that the storage of dissolved gas, in the tissues does not increase linearly with pressure. Moreover, as this storage takes place progressively, it increases with the hold time at a determined depth.

The calculation circuits 12 are thus a multivariable weighting integrator, i.e., pressure and duration, which cyclically calculates the quantity of gas breathed in that is supposed to be dissolved in the tissues. The parameters allowing this calculation have been empirically determined beforehand based on theoretical data, specifically, biological, physiological and mathematical data, as well as experimental data to form an integration calculation algorithm. (reference)

When the diver wants to reach the water surface, he/she can thus see, on the display 9, the depth of a lower decompression stop, at the level of which he can ascend in principle without any risk, and the minimum duration he should stay there. Then, the computer 1 having thus checked that the stop has been respected, in terms of pressure and duration, it validates the display of a following stop, to thus restart a series of decompression cycles and finally allow the ascent to the water surface.

The ambient pressure is provided by a sensor 4 associated to a computer 1 and connected at the output by a connection 5, in this case a wired connection, or even integrated in it.

The blood flow sensor 2 provides a signal transforming the noise level at the thorax. In particular, this noise may partly come from the circulation of a flow of gas bubbles escaping from the tissues where the gas breathed in has been stored. A corresponding signal is transmitted through a connection 3, for example wired or preferably radio as in this case, i.e., with an electromagnetic transmitter, to a corresponding receptor 13 connected at the output to a first inlet of a comparator 15 of the central processing unit 11, a second inlet of which is controlled by a noise high threshold memory 14. Here, the high threshold value represents a noise corresponding to the aforementioned degree 1, possibly degree 2.

A selective band-pass filter may be provided, to remove a band from the acoustic spectrum not concerned by the noise of the circulating flow of bubbles. Comparator 15 thus performs a processing of the received electric signal, representing a sound signal emitted by the Doppler sensor 2 and sent back towards the latter by a target vascular zone, with a significant shift in frequency of the density level of the bubbles. This shift is thus translated in bubble flow level by comparator 15 to provide at the output an alarm signal if the measured noise level exceeds the high threshold. In a similar case, the binary alarm signal is transformed into a signal capable of being displayed on display 9, as for example a signal for turning on an indicator or an alarm icon. Meanwhile, in addition or instead of, any other type of man-machine relationships, for example a control indicator of a vibrator, may be provided.

Apart from the purely warning aspect, it may also be provided that the alarm signal from the comparator 15 causes restrictive actions, i.e., the triggering of a device that tends to limit, or even prevent, the immediate pursuit of ascent to the water surface. This trigger may however be delayed, i.e., that it only intervenes if the alarm signal remains on for a certain time. Likewise, it can be provided that the reaching of a super alarm, maximum threshold, be detected thus with a higher flow of bubbles than for the alarm threshold, in order to trigger the actions of securing the diver.

A mini ballast forming an air bladder 7 which opens to make the device lose some of its buoyancy and consequently the buoyancy diver may be thought about. Thus, the alarm signal controls an electric mini motor that opens a venting valve.

The purpose of such an active device is that the diver is thus protected even if he does not react to the invitation to moderate his ascent speed. It is particularly interesting if for a reason whatsoever, the diver is unconscious.

In this case, a dual ballast device, whereof a pressurized gas bottle will swell, through a controlled inlet valve, the air bladder 7 if the diver goes back down to a certain depth with respect to the depth at which the alarm intervened, may be provided.

In short, a higher "safety net" against an embolism, or even a few at different pressures, may be established, and a same number of lower "nets", against drowning by immersion at great depths may be provided.

In this example, besides the alarm signal, which is a binary information notifying the diver that he has reached a high safety barrier against embolism, the computer 1 provides the decompression stops information of circuits 12 but by modulating them in order to add a duration supplement to any stop that is temporally close so that the alarm signal would have normally disappeared at the end of the stop extension. The stop in question is thus extended by a duration supplement which is calculated according to stored parameters, defined beforehand by tests, this duration being even longer when the bubble flow level is greater. It may be also possible that the computer 1 proposes an additional stop, i.e., intermediary or at an end of an ascent profile.

Here, the possible alarms are provided to lead, during a succession of dives, to a customization of the data of the basic able of circuits 12. In particular, the supplements of the stops, calculated every time, will be integrated, by means of said stored parameters, in the durations of original stops as initially stored. The central processing unit 11 will thus, with memorization, make the basic table of the circuits 12 progress according to the modulation of the duration that the above supplements represent.

Accordingly, the central processing unit 11 cyclically provides a corrected value of stop duration, if such is the case, to a buffer 16 connected at the output to a first inlet of a low-pass filter 17 supplying an ascent profile adjusting parameter memory 18. The low-pass filter 17 is thus an integrator which only allows one progressive update of the parameter memory 18, i.e., that a few dives will be needed, with substantially the same supplements of stop durations, for these supplements to be taken into account. For example, the data in the parameter memory 18 may be applied on a second inlet of low-pass filter 17, with a gain according to a 0.8 multiplicative factor whereas peer data on the first inlet will be weighted by a 0.2 factor. Thus, here, the duration supplements are taken into account with a rate of 20% each time. The parameter memory 18, with a thus adaptive content, will hence, in a loopback mode, supply circuits 12.

However, it may be possible to allow a reduction in the duration of the stop, as long as a predefined low limit has not been reached. In such a case, it may be possible to increase the time constant of the low-pass filter 17, i.e., to detect the sign of the correction reaching the first inlet to switch the respective gains of the first and second inlets, for example 0.95 and 0.05. The sign here above thus controls the addressing of one dual-position memory for respectively both gain pairs above, this memory controlling the two multiplying circuits for the two respective inlets.

The data in the parameter memory 18 may be the durations of decompression stops, i.e., final data, to display, or the aforementioned parameters for calculating these durations by means of algorithms taking into account the immersion duration at each depth and possibly a measured level of bubbles, these two variables also being memorized in the parameter memory 18.

Figure 2:
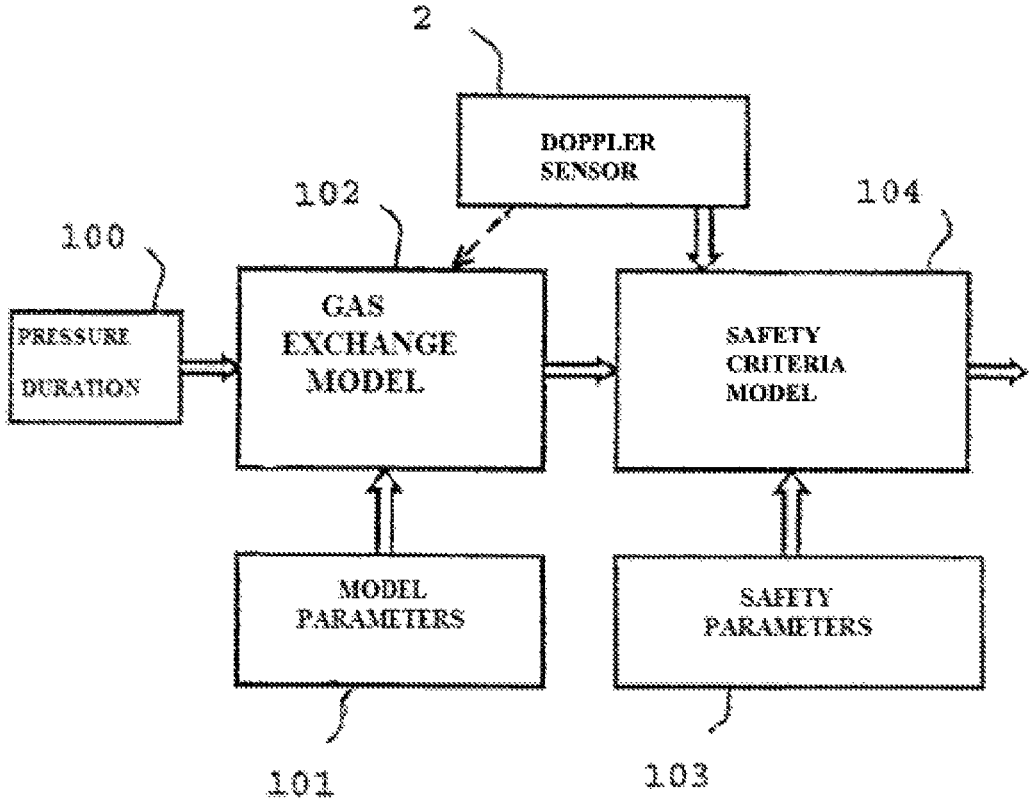
FIG. 2 is a synoptic illustrating the calculations carried out in the device.

FIG. 2 is a synoptic illustrating the calculation carried out in the calculation circuits 12 in combination with the parameter memory 18. Reference 102 designates an gas exchange model, for example the classic Haldane model or a model derived therefrom, i.e., an algorithm parametered by parameters (functional block 101, in memory 18) of the model such as a number of compartments representing the various tissues of the human body and proper time period values of decline of the saturation of these various compartments. In this model, a compartment represents a standard tissue, i.e., a mathematical entity having a same perfusion rate and a homogenous repartition of the dissolved gases, and whereof the behavior is different from that of neighboring tissues. Each tissue or compartment is characterized by a desaturation time constant, expressed for example in terms of "half-life" of the presence of dissolved gas. The functional bloc 100 represents the measured pressure values, throughout the dive, and duration associated to each pressure. Thus, it is these two variables which will be treated by the bloc of gas exchange model 102 to provide a vector value which will be representative of the discharge of gas generated by each of the different tissues of the model at a given time.

A functional bloc 104, of safety criteria model according to the invention, located downstream from the model bloc 102, carries out the indicated calculations to provide an alarm and also to determine a "safe" allowable ascent profile, based on the vector value above and the measure of the bubble level provided by the Doppler sensor 2. The operation of the safety model bloc 104 is parametered by the safety threshold value, in memory 18, here a functional bloc 103. In addition, this example also takes into account predetermined safety parameters such as a critical volume value, i.e., the allowable volume limit of degassing of all said compartments of the body, or even a critical supersaturation coefficient.

In a particular application, bloc 102 is arranged to receive the signals of the Doppler sensor 2, being also able to constitute a value representing the gas discharge from the different compartments. These signals may be advantageously processed according to an algorithm of a so-called bubble-growth model, of which illustration being the VPM (Variable Permeability Model) model, found in "Computation of reverse dive profiles contrasts and comparison", by BR Wienke, editor Lang and Lehner editorial Proceeding of Reverse Dive Profile Workshop, Washington, Smithsonian Institution, 1999, possibly confirming or thus completing the aforementioned vector value.

More generally, the parameter memory 18 constitutes a customized history of the reactions of the diver in question. Besides the real-time operation outlined above, aiming to precisely adapt the dive table according to the reactions of the diver in question, this history may be transmitted to the outside in order to be integrated with peer histories established by other same devices used by other divers, to constitute a database 50 having a statistical value regarding the reactions of the human body. Preferably after ascending to the water surface, the contents of the parameter memory 18 is transmitted to the database 50 for convenience by means of radio circuits 19, or by a port, non illustrated, of connection to a data transmission network 100, for example, Internet. Alternatively, the parameter memory 18 is removably mounted in order to be transferred temporarily to the database 50, or on a linking driver with the network 100, for the purpose of copying its history. The parameter memory 18 is for example a flash memory or even a magnetic floppy disk. The device according to the invention is hence a tool for setting-up standard tables.

Such a database 50 thus makes it possible to refine the durations of a priori established decompression stops by calculation, in standard dive computers. Thus, if it is noticed that for a large number of histories of divers, for example 30 or 100, no bubbles appear for a determined ascent profile, the duration of the stops may be reduced. Measurement campaigns for the various provisional editions of the table of durations will thus allow to determine the "low limit" durations of stops from which bubbles begin to appear, and the universal final table, will be established by taking a safety margin by increasing these "low limit" durations. Thus it globally relates to an iterative optimization that makes it possible to avoid unnecessarily imposing very long stops by ensuring that a Gaussian, representing the reaction thresholds per bubbles upon decompression of the sample of monitored divers, is located (almost) entirely on the side of the durations higher than the threshold for the most sensitive diver, i.e., the most reactive to decompression.

In this example, the central processing unit 11 further carries out a second monitoring of the bubble volume level in the blood according to the principle outlined above, but with an allowable level of threshold noise lower than the alarm threshold. In practice, the threshold memory 14 contains both thresholds and the comparator 15 operates in an alternated manner. The principle of the second monitoring however uses a second parameter, which is pressure, and specifically, the second monitoring is only exerted for ambient pressure exceeding a certain threshold, for example 1 overpressure atmosphere, i.e., around more than 10 meters depth. In fact, under 10 meters, the appearance of bubbles in the blood should not normally occur. If however it is the case, this means that one is in abnormal condition. This information is thus displayed on the display 9. It is however only a mere warning as there is no medical risk. The diver is merely informed that there is a risk that the alarm will go off if he/she continues his ascent. Thus, he/she may avoid "stumbling into" the high "safety barrier".

The alarm, and even the warning, may further be transmitted to remote receptors by means of transceiver circuits 19, for example devices such as this one, whereof the computer is provided to display also the alarms of "neighboring" devices. The transmission above may be automatic or controlled by the keyboard 8. The divers of a group may thus rescue each other in advance, if need be, particularly if an alarm subsists beyond a maximum threshold duration. A monitoring apparatus on the surface may likewise be warned.

An interesting application of the device is connected to the fact a diver who has ascended to the water surface may continue to wear it easily for example from one to three hours, as the risk linked to an excessive level of gas bubbles may still appear during this period.

Likewise, the device may particularly be used in a hyperbaric chamber, in decompression phase. In fact, the first parameter taken into account is pressure, and the value of this parameter results from the pressure of the ambient fluid, i.e., water, during a dive, or free or hyperbaric chamber air.

In the case of a hyperbaric chamber, the computer 1 may thus be operated by an "external" person, i.e., in charge of managing the temporal decompression profile of the hyperbaric chamber. In a similar case, it is convenient that the connection 3 has a sufficient range to be able to put the computer 1, or at least the display 9, outside the hyperbaric chamber. In the case of a radio connection 3, the chamber's porthole window, in glass or equivalent, makes it possible to maintain a breach in the Faraday cage that it constitutes if it is moreover metallic. If it is intended to deport outside the chamber all the functions of computer 1, the latter may no longer be hand held, and for example be only portable, i.e., with a weight that can reach a few kilograms. Similarly, these functions may be integrated in a standard computer or a computer for managing the chamber, equipped with the required software, with particularly two inlet ports for respectively the connection 3 for measuring the gas flow level and for the inner pressure of the chamber, the latter being provided by the pressure sensor 4 or by an electronic equipment driving the chamber.

The invention claimed is:

1. A safety device comprising:

a portable acoustic sensor for measuring an acoustic signal representative of a quantity of bubbles in a body of a person;

a portable pressure sensor for measuring ambient pressure;

at least a fixing device adapted to hold said acoustic sensor and said pressure sensor on said person; and a computer adapted to receive bubble information and pressure information from said acoustic sensor and said pressure sensor, and to modulate a duration of at least one decompression stop based on said bubble information and pressure information.

2. The device according to claim 1, wherein the computer is adapted to calculate durations of decompression stops of a basic table of decompression, and a central processing unit is arranged to calculate modulations of said durations of decompression stops.

3. The device according to claim 2, wherein the computer is arranged to modify and memorize said modulations of durations of decompression stops.

4. The device according to claim 1, wherein the fixing device is arranged so that the acoustic sensor can be coupled to a vascular site of said person.

5. The device according to claim 1, wherein the computer is adapted to communicate with the acoustic and pressure sensors through a wireless connection.

6. The device according to claim 1, wherein the computer is arranged in order to provide an alarm signal through alarm means if the level of measured bubble importance exceeds a predetermined safety threshold.

7. The device according to claim 6, wherein the computer comprises a wireless connection transceiver for exchanging said alarm signal with another safety device.

8. The device according to claim 6, further comprising activating means for modifying the buoyancy of the device in case of said alarm signal.

9. The device according to claim 6, further comprising activating means arranged to be activated by the computer in case of alarm to allow an inlet of safety gas in a breathing supply circuit of said person.

10. Use of a safety device according to claim 6, wherein said fixing device is coupled to a body of a person housed in a decompression chamber, and a gradual reduction of an overpressure level is carried out in the chamber by monitoring said alarm means to temporarily slow down said reduction in case of alarm.

11. A system comprising a plurality of devices according to claim 1 and a database containing diving profiles and communicating with said computer for receiving temporal decompression profiles followed by different persons, said system being adapted to:

memorize said temporal decompression profiles in the database with indication of risky sections of the profiles; and determine an envelope curve of the risky sections and memorize said envelope curves in the database.

12. A safety method comprising the following steps:

detecting by a portable acoustic sensor, an acoustic signal representative of a quantity of gas bubbles appearing inside a body of a person;

measuring said quantity of bubbles based on said acoustic signal;

measuring ambient pressure by a portable pressure sensor; and transmitting bubble information and pressure information from said acoustic sensor and said pressure sensor into a computer and modulating in said computer, a duration of at least a decompression stop based on said bubble information and said pressure information.

13. The method according to claim 12, further comprising providing an alarm signal through alarm means if the measured quantity of bubbles exceeds a predetermined safety threshold.

14. The method according to claim 12, wherein said duration of said decompression stop is modulated according to a history of previous measurements of the quantity of bubbles.

15. The method according to claim 12, wherein said duration of said decompression stop is modulated according to at least a current measures of the quantity of bubbles carried out in real time during said decompression stop.

* * * * *